United States Patent [19]

Huggins

[11] Patent Number: 4,899,450

[45] Date of Patent: Feb. 13, 1990

[54] OPEN SIGHT ADDITION FOR A TELESCOPIC GUN SIGHT

[76] Inventor: Edward R. Huggins, P.O. Box 78, Klawock, Ak. 99925

[21] Appl. No.: 229,635

[22] Filed: Aug. 8, 1988

Related U.S. Application Data

[62] Division of Ser. No. 892,836, Aug. 4, 1986, Pat. No. 4,777,730.

[51] Int. Cl.[4] ..... F41G 1/38

[52] U.S. Cl. ..... 33/245; 42/101

[58] Field of Search ..... 33/245, 247, 252, 255, 33/259, 260, 261; 42/100, 101

[56] References Cited

U.S. PATENT DOCUMENTS

| | | | |
|---|---|---|---|
| D. 253,545 | 11/1979 | Chesnut | D22/8 |
| 374,202 | 12/1887 | Rice | 33/247 |
| 600,104 | 3/1898 | Weed | 33/255 |
| 1,210,191 | 12/1916 | Moore | 33/255 |
| 1,288,379 | 12/1918 | Burton | 33/255 |
| 1,602,116 | 10/1926 | Manahan et al. | 33/247 |
| 2,054,090 | 9/1936 | Marple | 33/46 |
| 2,556,903 | 6/1951 | Clark | 33/245 |
| 3,149,622 | 9/1964 | Mann | 33/252 |
| 3,463,430 | 8/1969 | Rubin et al. | 248/205 |
| 3,626,597 | 12/1971 | Darrah | 33/252 |
| 3,785,603 | 1/1974 | Apel | 33/247 |
| 3,831,285 | 8/1974 | Vissing | 33/244 |
| 3,961,423 | 6/1976 | Hrebar | 33/258 |
| 4,021,926 | 5/1977 | Hrebar | 33/258 |
| 4,429,468 | 2/1984 | Jimenez et al. | 33/245 |
| 4,461,087 | 7/1984 | Norman | 33/249 |

FOREIGN PATENT DOCUMENTS

| | | | |
|---|---|---|---|
| 42231 | 8/1887 | Fed. Rep. of Germany | 33/255 |
| 1572356 | 7/1980 | United Kingdom | 33/245 |

*Primary Examiner*—William A. Cuchlinski, Jr.
*Assistant Examiner*—Patrick R. Scanlon
*Attorney, Agent, or Firm*—Delbert J. Barnard

[57] ABSTRACT

Provided is an open sight addition for a telescopic gun sight of a type having a front bell which includes a cylindrical forward portion and a frustoconical rearward portion. A sight bead is mounted on an upper central portion of the cylindrical forward portion of the bell. The sight beat projects vertically upwardly from the bell. An elongated sight line is formed on an upper central portion of the frustoconical rearward portion of the bell, rearwardly of and in axial alignment with the sight beam on the forward cylindrical portion of the bell. The sight bead and the sight line together form a sight plane.

2 Claims, 2 Drawing Sheets

OPEN SIGHT ADDITION FOR A TELESCOPIC GUN SIGHT

CONTINUING DATA

This application is a division of application Ser. No. 892,836, filed Aug. 4, 1986, now U.S. Pat. No. 4,777,730 which issued Oct. 18, 1988.

TECHNICAL FIELD

The invention relates to gun sights. More particularly, it relates to the provision of an open sight on the upper portion of a telescopic gun sight.

BACKGROUND ART

A telescopic gun sight is a telescope which includes cross hairs and which is mounted onto the gun, usually to serve as the sole means for aiming the gun towards a target. A problem with a telescopic sight is that it is difficult to use it to pick up a close, fast moving target such as a running deer. Also, atmospheric conditions may cause the sight to fog up and be unusable. Further, variable power telescopic sights must be turned down in power for close shots and this takes time. For this and other reasons, a telescopic sight would be essentially worthless if the gun had to be used quickly, to shoot a target at close range. For example, a hunter having a rifle equipped with only a telescopic sight would be in trouble if he were threatened by a bear at short distance.

U.S. Pat. No. 3,463,430, granted Aug. 26, 1969, to Irving N. Ruben and Ivan Jimenez and U.S. Pat. No. 4,429,468, granted Feb. 7, 1984, to Ivan Jimenez and Irving N. Reuben, each discloses a mount for a telescopic sight which includes an open sight avenue below the telescope. A rear sight element is mounted on the gun immediately forwardly of the telescopic sight. A front sight element is provided at the front end of the gun. These two sight elements define a sight line which is below the telescopic sight. A problem with this type of arrangement is that it is necessary to elevate the telescopic sight, thus moving the sight line of the telescopic sight sway from the axis of the gun barrel. Also, the sight line is restricted both horizontally and vertically making it more difficult to sight in on a target. This is because the user must sight through openings. The mounts which define the openings block the field of view both above and to the sides of the sight plane. Further, with the increased height of the telescopic sight above the gun, it is easier for the telescopic sight to make contact with brush, etc. when being carried through the woods. Also, it would prevent the use of a scabbard.

U.S. Pat. No. 3,961,423, granted June 8, 1976, to Matthew J. Hrebar, and U.S. Pat. No. 4,021,926, granted May 10, 1977, also to Matthew J. Hrebar, each discloses mounting an auxiliary sight on a gun mounted to one side of the telescopic sight. This requires a second attachment to the gun body and locates the sight at an unnatural position, viz. to one side of the barrel.

U.S. Pat. No. 4,461,087, granted July 24, 1984, to Ray Norman, discloses a telescopic sight mount which allows the telescopic sight to be swung over sideways, out of its normal position on top of the gun. This allows the user to use conventional open sights on the gun, but it requires an unlocking and moving of the telescopic sight.

U.S. Pat. No. D. 253,545, granted Nov. 27, 1979, to M. Gaines Chestnut, discloses a clip-on attachment for a telescopic sight. This attachment comprises an elongated support having an open sight element at each of its ends, and a pair of spaced apart spring clips. The spring clips are snapped over the telescopic sight, to in this manner position the attachment on the telescopic sight. A problem with this type of device is that it is not controllable; the attachment is easily moved in position on the telescopic sight. Also, it appears that the device could be easily knocked off.

U.S. Pat. No. 2,054,090, granted Sept. 15, 1936, to Matthiasm Marple, discloses an open sight attachment for a telescopic sight for an aircraft gun which comprises a pair of ring members which are attachable to front and rear portions of the telescopic sight. Each ring member carries a plurality of sight elements. The attachments disclosed by this patent have extremely long sight elements. If such a system were to be used on a rifle or pistol, it would be very easy for the sight elements to strike something, resulting in their either being moved out of alignment, and/or being physically damaged.

A principal object of the present invention is to provide an open sight addition for a telescope sight which provides a quick-to-use open sight plane on top of the telescopic sight, and comprises sight elements which are positioned closely adjacent the telescopic sight envelope.

DISCLOSURE OF THE INVENTION

In accordance with an aspect of the invention, an open sight addition for a telescopic gun sight is provided in the form of a ring attachable to a front bell portion of the telescopic gun sight. The mounting ring is a two-part ring comprising an upper major portion and a lower minor portion. The major portion extends about the bell of the telescopic gun sight for a distance greater than 180°. The minor portion extends about the bell of the telescopic gun sight for a distance less than 180°. The major portion and the minor portion both have fastener ears. The fastener ears on the major portion are positionable adjacent the fastener ears on the minor portion when the major and minor portions of the ring are positioned on the bell of the telescopic gun sight. A sight element is located on the upper major portion of the ring. Fastener means extend between the fastener ears on the major portion of the ring and the fastener ears on the minor portion of the ring, to secure the two ring portions together and clamp them into a secure position on the bell of the telescopic gun sight. When the mounting ring is on the bell of the telescopic gun sight, the mounting ears are located within a horizontal zone which is substantially tangent to the lower boundary of the bell portion of the telescopic sight, and is narrower than the diameter of the bell of the telescopic sight.

The mounting ring is relatively thin. The only projecting parts are the sight element and the fastener ears. The construction of the mounting ring into two parts, and the location of the fastener ears below the telescopic sight in nook areas formed by and between the telescopic sight and the gun, minimize the chance of the fastener ears catching on brush, etc., as the gun is carried through the woods. Preferably, the sight element is a short sight bead which projects only a small distance upwardly above the upper boundary of the telescopic sight.

In accordance with another aspect of the invention, the bell portion of the telescopic gun sight is provide with an axial sight groove which extends a substantial distance and, with the sight element on the mounting ring, forms a sight plane. Sight grooves have been used in other environments.

Other features of the invention are hereinafter described in the Best Modes for Carrying out the Invention.

BRIEF DESCRIPTION OF THE DRAWINGS

Like reference numerals are used to designate like parts throughout the several views of the drawings, and.

BEST MODES FOR CARRYING OUT THE INVENTION

Figure 1:
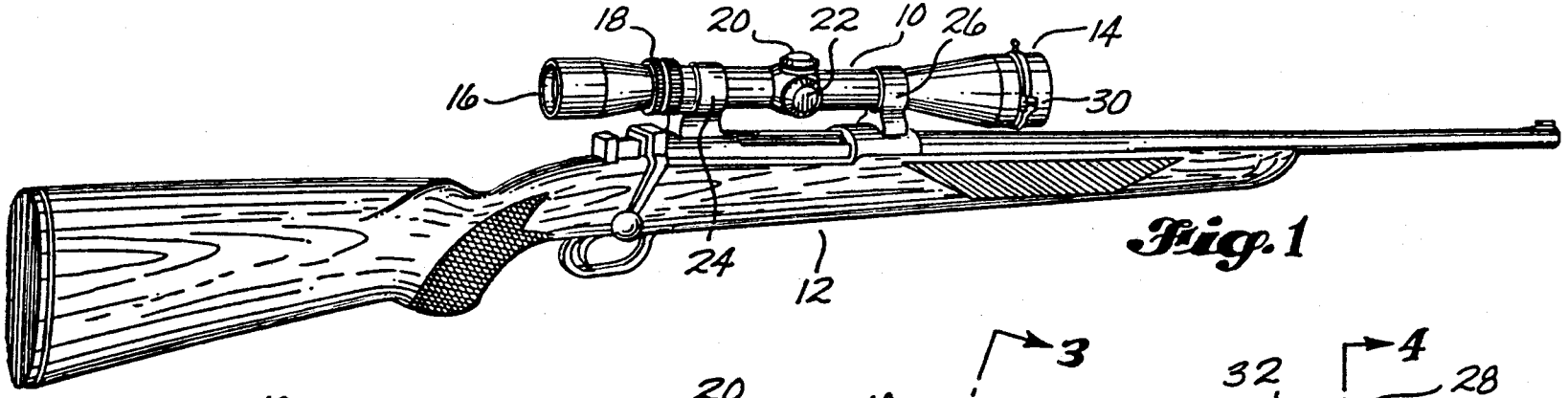
FIG. 1 is a pictorial view of a telescopic sight, mounted on a rifle, and including an embodiment of the invention.
Figure 2:
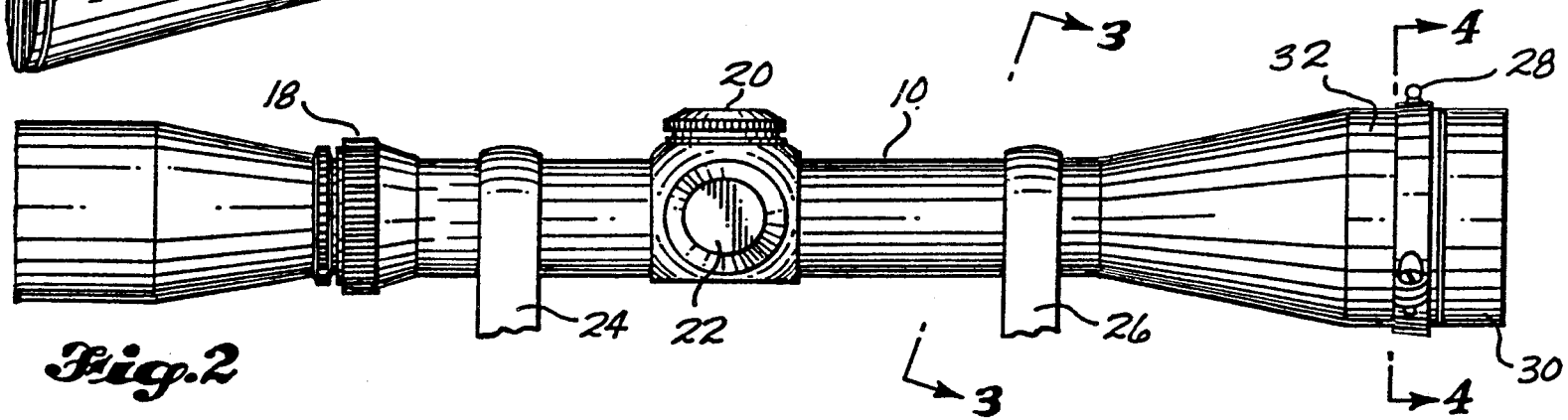
FIG. 2 is an enlarged scale side elevational view of the telescopic sight shown in FIG. 1, showing a front ring mounted open sight component, constructed in accordance with the present invention.

FIG. 1 shows a telescopic sight 10 mounted on top of a rifle 12. The particular telescopic sight 10 that is illustrated includes an enlarged forward end or "bell" 14. An eyepiece 16 is provided at the rear end of the telescopic sight 10. A focusing ring 18 is provided forwardly of the eyepiece 16. The sight 10 includes adjustable cross hairs which provide an internal sight line. Mechanism is provided for adjusting the cross hairs. This mechanism is accessible by removing a pair of caps 20, 22.

The telescopic sight 10 is mounted onto the rifle 12 by means of a pair of mounting rings 24, 26.

In this embodiment, an open sight element is provided at the forward end of the telescopic sight 10. Preferably, this forward sight element is a sight bead 28. It is centered on top of the telescopic sight 10 and is preferably positioned as far forward on the telescopic sight 10 as is possible. The particular telescopic sight 10 that is illustrated comprises a removable ring 30, which is part of the lens system. The forward sight element 28 is shown to be secured to an upper center portion of a forward mounting ring 32 positioned rearwardly adjacent ring 30.

Figure 4:
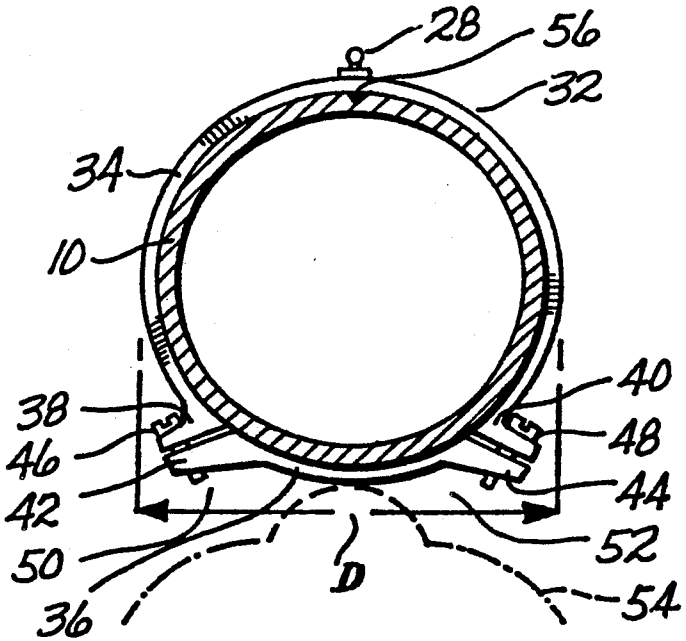
FIG. 4 is a sectional view taken substantially along line 4—4 of FIG. 2.

As best shown by FIG. 4, mounting ring 32 comprises an upper major portion 34 and a lower minor portion 36. Major portion 34 extends about the telescopic sight 10 an angular distance graeter than 180°. The minor ring portion 36 extends about the remainder of the telescopic sight 10. Thus, it extends a distance less than 180°. Major ring portion 34 includes two ends and fastener ears 38, 40 at its ends. Ring portion 36 also includes two ends and fastener ears 42, 44 at its two ends. When the two ring portions 34, 36 are assembled on the telescopic sight 10, the mounting ears 38, 40 are adjacent the mounting ears 42, 44, respectively. Fastener elements, which may be screw fasteners 46, 48, extend between the mounting ears 38, 42 and 40, 44, and serve to connect the two ring portions 34, 36 together. When tightened, the fastener elements 46, 48 also serve to clamp the mounting ring 32 in position on the large diameter forward end part of the bell portion of the telescopic sight 10. As will be readily understood, the position of the forward sight element 28 can be adjusted by rotating the forward mounting ring 32, while it is loose on the telescopic sight 10. Once adjusted, the fastener elements 46, 48 can be tightened for the purpose of securely clamping the mounting ring 32 in place.

As shown by FIG. 4, the fastener ear pairs 38, 42 and 40, 44 are located within a horizontal zone that is substantially tangent to the lower boundary of the front end of the telescopic sight 10. This zone has a width which is less than the diameter D of the tubular end of the telescopic sight 10. This places the fastener ear pairs 38, 40 and 40, 42 within protected zones or recesses 50, 52 which are formed by and between the lower portions of the tubular front end of the telescopic sight 10 and the upper portion of the gun barrel and stock 54. As a result, the fastener ear pairs 38, 42 and 40, 44 do not project outwardly any appreciable distance from the effective side boundaries of the sight gun combination 10, 12.

Figure 3:
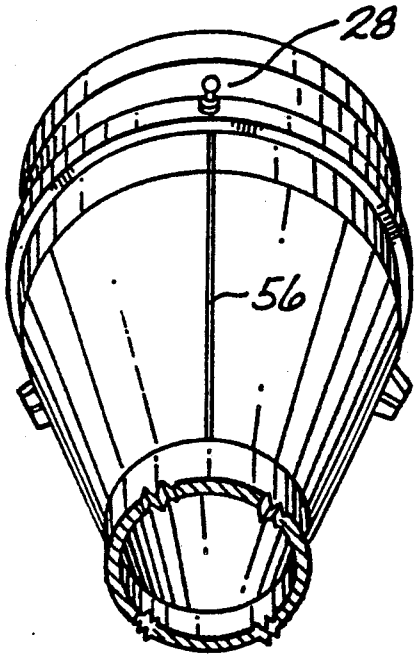
FIG. 3 is a view taken generally from the aspect of line 3—3 in FIG. 2, showing a front sight bead on the front ring and a sight blade engraved in the bell portion of the telescopic sight, extending rearwardly from the sight bead.

The forward sight element 28 may be used in conjunction with an elongated axial sight line 56, for defining a sight plane. As shown by FIG. 3, this sight line 56 is formed on the upper side boundary portion of the bell of the telescopic sight 10. Sight line 56 may be an etched line, a painted line, a rib, etc. When this combination of sight elements 28, 56 are used, the mounting 32 is positioned on the bell of the telescopic sight 10. Before the screws 46, 48 are tightened, the ring 32 is rotated to align the element 28 with the groove 56. Then, the screws 46, 48 are tightened. The entire telescopic sight 10 is then rotated within its mounts, for the purpose of centering the sight line established by elements 28, 56 within a substantially vertical plane.

By way of typical and therefore nonlimitive example, the dimensions of a front ring 32, for use with a telescopic sight having a bell with an outside diameter of 1 29/32 inches, are as follows: the bead is 3/32 inch wide at the top and is 1/16 inch long. The ring portions 34, 36 are 1/16 inch thick and 5/16 inch wide. The major ring portion 34 extends 270° and the minor ring portion 36 extends 90°.

Each of the sight systems of this invention gives the shooter a full view above the gun, resulting in the sight system being quickly usable to aim the gun at a target. The open sight addition does not detract from the normal use of the telescopic sight in any way. The open sight is readily available for use in those situations in which an open sight is superior to a scope sight, e.g. close range use or for aiming at a fast moving target. Each of the add-on sight components is very strong and durable. At the same time, they are small and can be made out of lightweight material. The simplicity of the add-on sight elements results in the system being relatively inexpensive. A system utilizing mounting rings can be very quickly and easily installed. The front sight element projects upwardly above the general envelope of the telescopic sight a very small amount.

It is to be appreciated that the sighting system described above could be altered somewhat without departing from the spirit and scope of the invention. In accordance with established patent law, the system that has been illustrated and described is not to be used for defining the invention to be protected. Rather, the limits of protection are specified by the appended claims. These claims are to be interpreted in accordance with established rules of patent claim interpretation, including the use of the doctrine of equivalents.

What is claimed is:

1. A telescopic gun sight of a type having a front bell which includes a cylindrical forward portion and a frustoconical rearward portion having an upper central surface portion which slopes upwardly to the cylindrical forward portion, and an open sight addition comprising:

a sight bead on an upper central portion of the cylindrical forward portion of the bell, said sight bead projecting vertically upwardly from the cylindrical forward portion of the bell;

an elongated sight line on said sloping upper central portion of the frustoconical rearward portion of the bell, rearwardly of and in axial alignment with the sight bead on the forward cylindrical portion of the bell, said sight line sloping upwardly towards the sight bead, and said sight bead and said sloping sight line together forming a sight plane on top of the telescopic gun sight and together forming an open sight addition to the telescopic gun sight; and said telescopic gun sight including no other open sight element rearwardly of the front bell, wherein in use of the open sight addition for aiming, the user sights along said sight line towards the sight beard and the target.

2. The combination of claim 1, wherein the sight bead is mounted on a mounting ring which surrounds the cylindrical forward portion of the bell, and said sight bead is connected to the mounting ring, and said mounting ring including means for securing it to the cylindrical forward portion of the bell.

* * * * *